US007074116B2

(12) United States Patent
Monnier et al.

(10) Patent No.: US 7,074,116 B2
(45) Date of Patent: Jul. 11, 2006

(54) HONING AND DEBURRING TOOL

(75) Inventors: Dennis Monnier, Shelby Township, MI (US); Alfred Walter, Nurtingen (DE)

(73) Assignee: Maschinenfabrik Gehring GmbH & Co. KG, Ostfildern (DE)

( * ) Notice: Subject to any disclaimer, the term of this patent is extended or adjusted under 35 U.S.C. 154(b) by 185 days.

(21) Appl. No.: 10/248,031

(22) Filed: Dec. 12, 2002

(65) Prior Publication Data

US 2003/0114089 A1 Jun. 19, 2003

(30) Foreign Application Priority Data

Dec. 15, 2001 (DE) ..... 201 20 294 U

(51) Int. Cl.
*B24B 5/08* (2006.01)

(52) U.S. Cl. ..... 451/65; 451/69; 451/462; 408/27

(58) Field of Classification Search ..... 451/65, 451/69, 461, 462, 61, 155, 470, 472, 478, 451/430; 408/27
See application file for complete search history.

(56) References Cited

U.S. PATENT DOCUMENTS

| | | | | | |
|---|---|---|---|---|---|
| 2,978,846 | A | * | 4/1961 | Barron | 451/541 |
| 3,405,049 | A | * | 10/1968 | Czubak | 204/217 |
| 4,434,588 | A | * | 3/1984 | Wada et al. | 451/476 |
| 4,896,638 | A | | 1/1990 | Shepley | 123/188 |
| 5,417,525 | A | * | 5/1995 | Lenhart | 408/24 |
| 5,601,476 | A | | 2/1997 | Maier et al. | 451/51 |

FOREIGN PATENT DOCUMENTS

| | | |
|---|---|---|
| DE | 31 16 326 | 11/1982 |
| DE | 197 38 500 | 3/1999 |
| WO | 01/39926 | 6/2001 |

* cited by examiner

*Primary Examiner*—Robert A. Rose
(74) *Attorney, Agent, or Firm*—Gudrun E. Huckett

(57) ABSTRACT

A combination tool for machining a bore has a tool shaft transmitting a rotational movement and an oscillating movement in an axial direction of a bore to be machined with the tool. A horning tool is arranged on the tool shaft, and a deburring tool is arranged on the tool shaft at an axial spacing to the honing tool in a direction of a longitudinal axis of the tool shaft. The honing tool is configured to move for each honing stroke between a lower position and an upper position wherein a spacing between a lower edge of the honing tool and a lower edge of the deburring tool in the direction of the longitudinal axis of the tool is greater than a spacing of the lower edge of the honing tool to a workpiece surface when the honing tool is in the lower position.

17 Claims, 2 Drawing Sheets

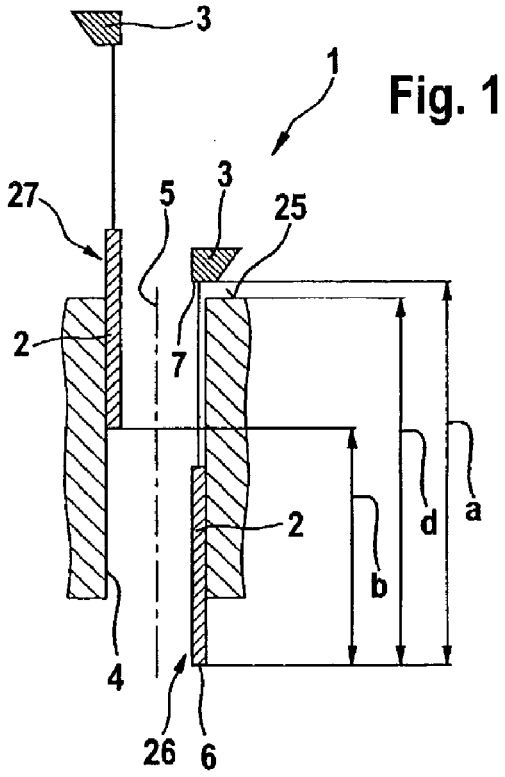
Fig. 1
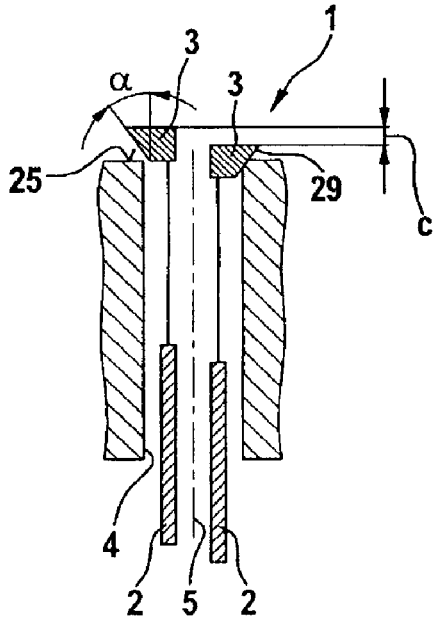
Fig. 2
Fig. 4
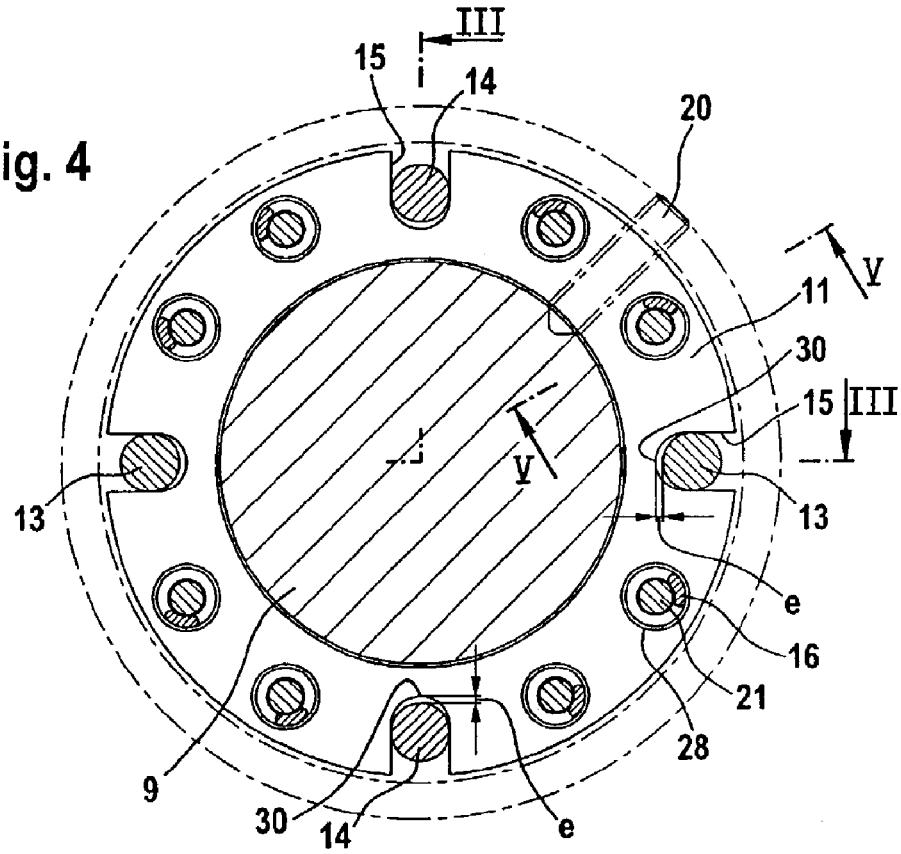

HONING AND DEBURRING TOOL

BACKGROUND OF INVENTION

1. Field of the Invention

The invention relates to a tool for machining a bore. The tool comprises a honing tool wherein the tool has a tool shaft for transmitting a rotary movement and an oscillating movement in the direction of the axis of the bore.

2. Description of the Related Art

U.S. Pat. No. 5,601,476 describes a method for deburring honed bores. The tool for performing this method has a guide rod which is arranged in the bore during machining of the bezel in order to ensure excellent concentricity of the bore and of the bezel. According to this method, in a first machining step the bore is produced and in a second step a bezel having a first cone angle is machined, wherein subsequently the bezel is completed by machining the final cone angle in a third machining step. This method is time-consuming and cost-intensive because either the tool must be changed or separate stations for machining and for deburring of the bore must be provided.

SUMMARY OF INVENTION

It is an object of the present invention to provide a tool with which honing and deburring of a bore can be performed easily, quickly, and cost-efficiently.

In accordance with the present invention, this is achieved in that the deburring tool is arranged on the tool shaft at an axial spacing to the honing tool relative to the direction of the axis of the bore.

The arrangement of the deburring tool at an axial spacing to the honing tool relative to the direction of the axis of the bore enables honing and subsequent deburring of the honing bur in a single working step so that it is not necessary to change tools. In particular, when using the honing tool on a honing machine with numerical control (NC) spindle, honing and deburring can be performed in an automated working step.

In order to prevent a collision of the deburring tool with the workpiece during the honing process, it is provided that for a honing stroke between a lower position and an upper position the spacing between the lower edge of the honing tool and the lower edge of the deburring tool in the direction of the axis of the bore is greater than the spacing of the lower edge of the honing tool relative to the workpiece surface when the honing tool is in the lower position.

Expediently, the deburring tool comprises individual deburring elements. The deburring elements can be brushes, sintered slats with bonded abrasive or cutting edges with defined geometry. Expediently, the deburring tool comprises a deburring ring on which the deburring elements are arranged. It is expedient to support the deburring ring so as to be movable in the radial direction. In this way, axial displacement between the deburring tool and the bore can be compensated. The deburring ring is advantageously supported by pins, in particular, by two pins arranged on an intermediate ring and spaced at a spacing of 180° relative to one another about the axis of the bore. The intermediate ring is supported by pins, in particular, by two pins spaced at a spacing of 180° relative to one another about the axis of the bore on a fixed ring which is secured on the tool shaft. The pins between the deburring ring and the intermediate ring and the pins between the intermediate ring and the fixed ring are advantageously displaced relative to one another by 90° about the axis of the bore. In order to ensure sufficient play of the deburring ring in the radial direction, the intermediate ring is provided with cutouts for receiving the pins. The cutouts are formed, in particular, as grooves distributed about the periphery. The grooves provide a simple possibility for supporting the deburring ring. At the same time, the play of the deburring ring is also limited by means of the depth of the groove. Satisfactory play of the pins in the grooves enables additionally also tilting of the deburring ring.

It is provided that the deburring ring is movable in the axial direction; in particular, it is supported in a springy way. Expediently, the deburring ring is supported on the fixed ring by means of compression springs wherein, in particular, eight compression springs are arranged between the deburring ring and the fixed ring. The compression springs extend through a bore in the intermediate ring, respectively. The springy support ensures a safe contact of the deburring elements on the bore edge. The bores in the intermediate ring serve as an outer guide for the compression springs.

Advantageously, a stop for the deburring ring is provided on the tool shaft which stop, in particular, is arranged under the deburring ring and is formed as a tapering cone which tapers in a direction opposite to the taper of the deburring ring.

BRIEF DESCRIPTION OF DRAWINGS

FIG. 1 is a schematic illustration of the tool during honing.

FIG. 2 is a schematic illustration of the tool during deburring.

FIG. 4 shows a section along the line IV—IV of FIG. 3.

DETAILED DESCRIPTION

Figure 3:
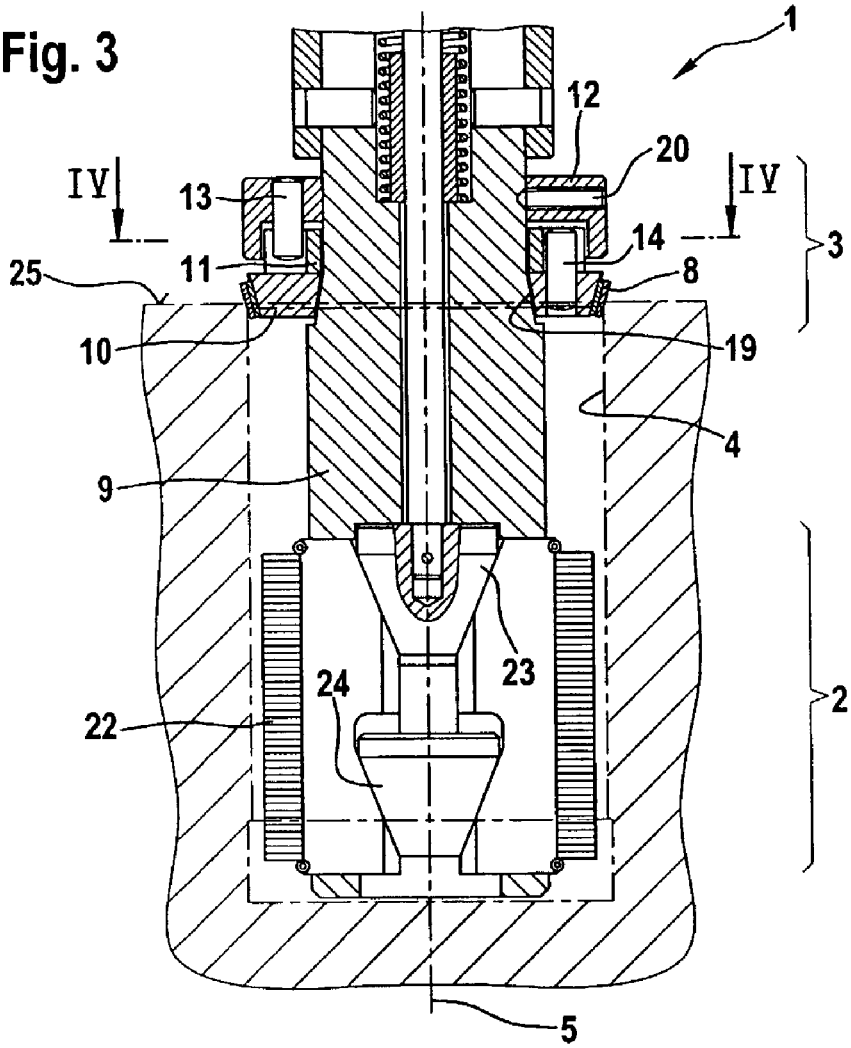
FIG. 3 is a longitudinal section of a combination honing and deburring tool along the line III—III of FIG. 4.

FIG. 1 shows a tool 1 which is a combination tool of a honing tool 2 and deburring tool 3, illustrated schematically during the honing process. The honing tool 2 rests against the inner wall of the bore 4 and carries out a honing stroke b in which it is moved oscillatingly between a lower position 26 and an upper position 27. The spacing a between the lower edge 6 of the honing tool 2 and the lower edge 7 of the deburring tool 3 is greater than the spacing d between the workpiece surface 25 and the lower edge 6 of the honing tool 2 in its lower position 26. In this way, the deburring tool 3 cannot contact the workpiece surface 25 when the honing stroke b is performed.

FIG. 2 shows the tool 1 during the deburring process. The honing tool 2 is in a position below the lower position 26 of the honing stroke b and the honing tool does not contact the wall of the bore 4. The deburring tool 3 whose cutting edge 29 is slanted at an angle $\alpha$ relative to the axis 5 of the bore 4 carries out the deburring stroke c in the area of the workpiece surface 25. The oscillating movement in the longitudinal direction of the axis 5 of the bore and the simultaneous rotational movement about the axis S of the bore 4 causes deburring of the bore 4.

In the FIG. 3 an embodiment of a tool 1 during the deburring stroke c is illustrated. The tool 1 comprises a honing tool 2 and a deburring tool 3 arranged above the honing tool 2 viewed in the direction of the axis 5. The honing tool 2 comprises honing slats 22 which are forced by the cones 23 and 24 during the honing stroke against the inner wall of the bore 4. During the deburring stroke the honing slats 22 do not contact the inner wall of the bore 4. The honing tool 2 and the deburring tool 3 are arranged on a tool shaft 9 which transmits a rotational movement and an oscillating movement in the direction of the axis 5 of the bore from the honing machine onto the tool.

The deburring tool 3 comprises a fixed ring 12 secured by means of a threaded pin 20 on the tool shaft 9; an intermediate ring 11; and a deburring ring 10. On the deburring ring 10 the deburring elements 8 are arranged which are, for example, brushes, sintered slats with bonded abrasive or cutting edges with defined geometry. The deburring ring 10 has a conically shaped inner contour and rests against the cone 19 formed on the tool shaft 9. The cone 19 thus forms a stop for the deburring ring 10 in the axial direction. The deburring ring 10 is secured by two pins 14 on the intermediate ring 11 and the intermediate ring 11, in turn, by means of pins 14 on the fixed ring 12.

In FIG. 4, the pins 13, 14 are illustrated in section. Two pins 13 and 14, are arranged, respectively, in the peripheral direction spaced relative to one another by 180° about the longitudinal axis of the tool shaft 9 which coincides with the axis 5 of the bore. The pins 13, 14 project into grooves 115. The grooves 15 are located on the periphery of the intermediate ring 11 and extend in the radial direction. The bottom 30 of the grooves 15 in the unloaded state of the tool is spaced at a radial play e from the pins 13, 14, respectively, so that the deburring ring 10, by means of intermediate ring 11, has play relative to the fixed ring 12 in the plane illustrated in FIG. 4. The play of the pins 13, 14 in the grooves 15 enables also a tilting of the deburring ring 10 relative to the fixed ring 12.

The deburring ring 10 in the direction of the axis 5 (identical to the longitudinal axis of the combination tool) is supported in a springy way on the fixed ring 12. For this purpose, eight compression springs 16 are distributed in the peripheral direction. Two compression springs 16 are positioned at a spacing of 30° relative to one another between a pin 13 and a pin 14, respectively.

Figure 5:
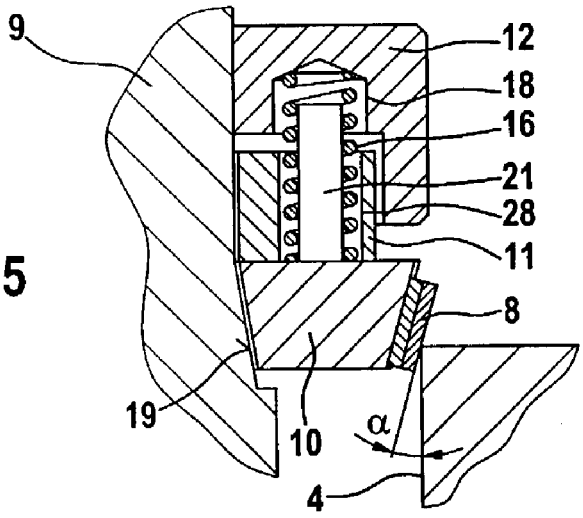
FIG. 5 shows a section along line V—V in FIG. 4.

In FIG. 5 a section of a compression spring 16 is illustrated. The compression spring 16 is supported on the deburring ring 10 and extends through a bore 28 in the intermediate ring 11. The compression spring 16 is arranged in a blind bore 18 on the fixed ring 12. The compression spring 16 is guided by a guide pin 21 on its inner side. The compression spring 16 has sufficient play within the blind bore 18 so that radial movements between deburring ring 10 and fixed ring 12 can be compensated. By means of the compression spring 16, the deburring element 8 arranged on the deburring ring 10 is forced against the edge of the bore 4. The deburring element 8 is slanted at an angle $\alpha$ relative to the axis 5 of the bore. The angle $\alpha$ thus represents at the same time the bezel angle to be produced. When the deburring element 8 contacts the upper edge of the bore 4, the compression spring 16 is compressed so that the deburring ring 10 does not contact with its inner side the cone 19 of the tool shaft 9.

In place of several compression springs rings 16 distributed peripherally, it is also possible to employ a spring which is arranged concentrically about the axis 5. The deburring ring can also be arranged directly on a fixed ring, thus eliminating the intermediate ring.

While specific embodiments of the invention have been shown and described in detail to illustrate the inventive principles, it will be understood that the invention may be embodied otherwise without departing from such principles.

What is claimed is:

1. A tool for machining an interior surface of a bore, the tool comprising:

a tool shaft adapted to perform a rotational movement around an axis of said tool shaft and an oscillating movement in an axial direction of said tool shaft;

a honing tool mounted on said tool shaft;

wherein said honing tool comprises honing slats moveable in a radial direction of said tool shaft;

wherein said honing tool further comprises means for pressing said honing slats against an interior surface of a bore for performing a honing operation on the interior surface of the bore;

a deburring tool mounted on said tool shaft at an axial spacing from said honing tool;

wherein said deburring tool has a surface slanted at a slant angle relative to said axis of said tool shaft for deburring an edge of the bore which edge adjoins a workpiece surface surrounding the bore;

wherein said honing tool is adapted to move for each honing stroke between a lower honing position and an upper honing position in said axial direction, wherein a spacing between a lower edge of said honing tool and a lower edge of said deburring tool in said axial direction is greater than a spacing of said lower edge of said honing tool to the workpiece surface when said honing tool is in said lower honing position such that said lower edge of said honing tool is in a position below said lower honing position when said deburring tool contacts the workpiece surface at the edge of the bore.

2. The tool according to claim 1, wherein said slant angle matches a bezel angle of the bore to be produced by deburring.

3. The tool according to claim 1, wherein said deburring tool comprises individual deburring elements.

4. The tool according to claim 3, wherein said deburring elements are brushes.

5. The tool according to claim 3, wherein said deburring elements are sintered slats provided with bonded abrasive.

6. The combination tool according to claim 1, wherein said deburring tool comprises a deburring ring on which said deburring elements are arranged.

7. The tool according to claim 6, wherein said deburring ring is supported on said tool shaft so as to have radial play.

8. The tool according to claim 6, wherein said deburring tool further comprises an intermediate ring and first pins, wherein said deburring ring is supported by said first pins on said intermediate ring.

9. The tool according to claim 8, wherein said deburring tool further comprises a fixed ring fixedly connected to said tool shaft, wherein said fixed ring comprises second pins, wherein said intermediate ring is supported by said second pins on said fixed ring.

10. The tool according to claim 9, wherein two of said first pins are provided and are spaced from one another by 180° relative to said axis of said tool shaft.

11. The tool according to claim 8, wherein said intermediate ring has cutouts for receiving said first and second pins.

12. The tool according to claim 11, wherein said cutouts are peripherally arranged grooves.

13. The tool according to claim 8, wherein said deburring ring is movably supported in the direction of the longitudinal axis of said tool shaft.

14. The tool according to claim 13, further comprising spring means for supporting said deburring ring.

15. The tool according to claim 14, wherein said spring means are springs extending through bores provided in said intermediate ring.

16. The tool according to claim 6, comprising a stop for said deburring ring, wherein said stop is provided on said tool shaft.

17. The tool according to claim 16, wherein said stop is a cone arranged below said deburring ring and tapering in a direction opposite to a taper of said deburring ring.

* * * * *